US007330556B2

(12) United States Patent
Kates

(10) Patent No.: US 7,330,556 B2
(45) Date of Patent: Feb. 12, 2008

(54) BINAURAL SIGNAL ENHANCEMENT SYSTEM

(75) Inventor: James M. Kates, Niwot, CO (US)

(73) Assignee: GN ReSound A/S (DK)

( * ) Notice: Subject to any disclaimer, the term of this patent is extended or adjusted under 35 U.S.C. 154(b) by 658 days.

(21) Appl. No.: 10/407,305

(22) Filed: Apr. 3, 2003

(65) Prior Publication Data

US 2004/0196994 A1 Oct. 7, 2004

(51) Int. Cl.
*H04R 25/00* (2006.01)

(52) U.S. Cl. ..... 381/312; 381/92; 381/313

(58) Field of Classification Search ..... 381/23.1, 381/92, 94.1, 94.2, 94.7, 312, 313, 316, 317, 381/320, 321, 314
See application file for complete search history.

(56) References Cited

U.S. PATENT DOCUMENTS 5,511,128 A * 4/1996 Lindemann ..... 381/92
5,651,071 A * 7/1997 Lindemann et al. ..... 381/314
6,430,295 B1 * 8/2002 Handel et al. ..... 381/94.7
6,983,055 B2 * 1/2006 Luo ..... 381/313
6,987,856 B1 * 1/2006 Feng et al. ..... 381/92

* cited by examiner

*Primary Examiner*—Huyen Le
(74) *Attorney, Agent, or Firm*—Bingham McCutchen LLP

(57) ABSTRACT

A signal processing system, such as a hearing aid system, adapted to enhance binaural input signals is provided. The signal processing system is essentially a system with a first signal channel having a first filter and a second signal channel having a second filter for processing first and second channel inputs and producing first and second channel outputs, respectively. Filter coefficients of at least one of the first and second filters are adjusted to minimize the difference between the first channel input and the second channel input in producing the first and second channel outputs. The resultant signal match processing of the signal processing system gives broader regions of signal suppression than using the Wiener filters alone for frequency regions where the interaural correlation is low, and may be more effective in reducing the effects of interference on the desired speech signal. Modifications to the algorithms can be made to accommodate sound sources located to the sides as well as the front of the listener. Processing artifacts can be reduced by using longer averaging time constants for estimating the signal power and cross-spectra as the signal-to-noise ratio decreases. A stability constant can also be incorporated in the transfer functions of the first and second filters to increase the stability of the signal processing system.

46 Claims, 6 Drawing Sheets

BINAURAL SIGNAL ENHANCEMENT SYSTEM

FIELD OF THE INVENTION

The present invention relates generally to apparatus and methods for binaural signal processing in audio systems such as hearing aids and, more specifically, to apparatus and methods for binaural signal enhancement in hearing aids.

DESCRIPTION OF PRIOR ART

A hearing impaired person by definition suffers from a loss of hearing sensitivity. Such a hearing loss generally depends upon the frequency and/or the audible level of the sound in question. Thus, a hearing impaired person may be able to hear certain frequencies (e.g., low frequencies) as well as a non-hearing impaired person, but unable to hear sounds with the same sensitivity as the non-hearing impaired person at other frequencies (e.g., high frequencies). Similarly, the hearing impaired person may be able to hear loud sounds as well as the non-hearing impaired person, but unable to hear soft sounds with the same sensitivity as the non-hearing impaired person. Thus, in the latter situation, the hearing impaired person suffers from a loss of dynamic range of the sounds.

A variety of analog and digital hearing aids have been designed to mitigate the above-identified hearing deficiencies. For example, frequency-shaping techniques can be used to contour the amplification provided by a hearing aid, thus matching the needs of an intended user who suffers from the frequency dependent hearing losses. With respect to the dynamic range loss, a compressor is typically used to compress the dynamic frequency range of an input sound so that it more closely matches the dynamic range of the intended user. The ratio of the input dynamic range to the output dynamic range by the compressor is referred to as the compression ratio. Generally, the compression ratio required by a hearing aid user is not constant over the entire input power range because the degree of hearing loss at different frequency bands of the user is different.

Dynamic range compressors are designed to perform differently in different frequency bands, thus accounting for the frequency dependence (i.e., frequency resolution) of the intended user. Such a multi-channel or multi-band compressor divides an input signal into two or more frequency bands and then compresses each frequency band separately. This design allows greater flexibility in varying not only the compression ratio, but also time constants associated with each frequency band. The time constants are referred to as the attack and release time constants. The attack time is the time required for a compressor to react and lower the gain at the onset of a loud sound. Conversely, the release time is the time required for the compressor to react and increase the gain after the cessation of the loud sound.

Moreover, many hearing-impaired individuals have hearing losses in both ears. As a result, each of these individuals needs to be fitted with two hearing aids, one for each ear, to address the hearing losses of both ears. Both hearing aids may contain dynamic-range compression circuits, noise suppression processing, and/or directional microphones. In general, the two hearing aids contain signal processing circuits and algorithms, and operate independently. That is, the signal processing in each of the hearing aids is adjusted separately and operates without any consideration for the presence of the other hearing aid. Improved signal processing performance, specifically binaural signal processing, is possible if left and right ear inputs are combined. Accordingly, some conventional hearing aid systems include left and right ear hearing aids that are capable of binaural processing.

Typically, the inputs at both ears of a listener include a desired signal component and a noise and/or interference component. In many listening situations, the inputs at the two ears of the listener will differ in a way that can be exploited to emphasize the desired input signals and reject the noise and/or interference. FIG. 1 illustrates a scenario in which a desired signal source comes directly from the front-center of the listener while various noise and/or directional interfering sources may come from other directions. Since the signal source is located in front of the listener, it generates highly correlated input singles at the two ears of the listener. Theoretically, if the signal source is directly in front-center of the listener, the input signals will be identical at the two ears. The noise or interfering sources will, however, generally differ in time of arrival, relative amplitude, and/or phase at the two ears. As such, if the signal source is not directly in front-center of the listener, or if there are noise or interfering sources surrounding the listener, the resulting inputs at the two ears of the listener will be different in time of arrival, relative amplitude, and/or phase, etc., leading to a reduced interaural correlation of the inputs at the two ears of the listener.

An object in binaural signal processing by a hearing aid system is therefore to design a pair of filters, one for each ear's hearing aid that will pass the desired input signals and suppress unwanted interfering sources and noise. Prior to implementing the pair of filters in the hearing aid system, it must be determined whether or not to use the same processing scheme in each filter.

If different filters are used for the left and right ear hearing aids, it is possible to compensate for the differences in amplitude and phase of the various inputs (e.g., input signals, interference and/or noise). As a result, it is possible to cancel a directional source of interference. Unfortunately, the output from this type of signal processing is usually monaural, causing the same output signal to be provided to both ears. As a result, the binaural signal processing and noise suppression function that is inherent in a healthy human auditory system will be supplanted by such an interference cancellation process. In situations in which there is a single strong source of interference in an anechoic environment, the hearing aid system will offer an improvement in speech intelligibility. If, however, the source of interference is diffuse rather than directional, the interference cancellation process will not be very effective in improving speech intelligibility. Furthermore, since the processed output signal is monaural, this hearing aid system will not provide a normal localization mechanism as performed by a healthy human auditory system.

The alternative approach is to have the left and right ear filters of the hearing aid system be the same. The left and right ear filters filter the left and right ear inputs, respectively, to generate different left and right outputs. Forcing the two filters to be the same precludes the cancellation of a broadband directional source of interference. This, however, allows for a reduction of gain in frequency regions where the interference dominates. Thus, it is possible to increase a measured signal-to-noise ratio (SNR) of a processed output using this type of filtering approach. Because the left and right outputs are generated using identical signal processing filters, the interaural amplitude ratio and the phase difference of both inputs are preserved and the binaural localization mechanism can continue to function nearly normally for the user. Many of the conventional hearing aid systems include directional microphones under the assumption that a directional microphone built into a hearing aid at each ear of the user will be effective in canceling a single directional source of interference. Accordingly, no additional interference cancellation process is required for these conventional hearing aid systems. These conventional hearing aid systems are therefore built based on forcing the left and right ear filters of each hearing aid system to be identical.

Several different strategies have been described by the prior art for binaural signal enhancement in a hearing aid system utilizing the same signal processing filters for the left and right ear inputs. For instance, the interaural amplitude and phase differences of both inputs have been exploited in hearing aid systems described in "Real-time multiband dynamic compression and noise reduction for binaural hearing aids" by Kollmeier, Peissig, and Hohmann (1993), J. Rehab. and Devel., vol. 30 , pp 82-94 ; "Speech enhancement based on physiological and phychoacoustical models of modulation perception and binaural interaction" by Kollmeier and Koch (1994), J. Acoust. Soc. Am., vol. 95 , pp 1593-1602 ; AudioLogic system designs by Lindemann; and "Development of digital hearing aids" by Schweitzer (1997), Trends in Amplification, vol. 2, pp 41-77. These hearing aid systems generally pass the inputs in those frequency regions where the amplitudes and phases of the inputs tend to agree, and reduce compression gains in those frequency regions where the amplitudes and phases differ.

Another strategy described in the prior art exploits the interaural signal correlation of the inputs at the left and right ears. Such hearing aid systems are described in "Multimicrophone signal-processing technique to remove room reverberation from speech signals" by Allen, Berkley, and Blauert (1977), J. Acoust. Soc. Am., vol. 62 , pp 912-915 ; the above-mentioned 1993 article by Kollmeier, Peissig, and Hohmann; "Two microphone nonlinear frequency domain beamformer for hearing aid noise reduction" by Lindemann (1995), Proc. 1995 Workshop on Applications of Signal Processing to Audio and Acoustics, Mohonk Mountain House, New Paltz, N.Y.; and U.S. Pat. No. 5,511,128 , entitled "Dynamic intensity beamforming system for noise reduction in a binaural hearing aid" and issued to Lindemann (1996). The hearing aid systems with such a cross-correlation technique pass the inputs in those frequency regions where the interaural signal correlation is high, and attenuate the inputs in those regions where the correlation is low. In addition, combinations of amplitude, phase, and correlation functions have also been suggested to determine a preferred frequency response of the binaural filters, as described by the above-mentioned 1993 article by Kollmeier, Peissig, and Hohmann and in "Two-channel noise reduction algorithm motivated by models of binaural interaction" by Wittkop (2001), Ph.D. Thesis, Universitat Oldenburg, Germany. A further modification to the hearing aid system is suggested in U.S. Pat. No. 5,651,071 , entitled "Noise reduction system for binaural hearing aid" and issued to Lindemann and Melanson (1997), that combines an interaural correlation function with additional signal features such as voiced speech detection.

Another approach in the prior art is to use a model of binaural localization in signal processing to design the binaural enhancement filters of the hearing aid system. As has been suggested by the above-mentioned Wittkop's Ph.D. thesis, amplitude and phase differences of the inputs can provide an implied localization model for signal processing since these are gross signal cues used by the human auditory system to determine the direction of a source of sound. Yet another more explicit modeling approach is taken in "Binaural signal processing system and method" by Feng et al. (2001), IEEE Trans. Acoust. Speech and Sig. Proc., vol. ASSP-35 , pp 1365-1376 , which discloses a signal processing method based on a coincidence-detection model of binaural localization to derive a binaural enhancement filter. In this system, the inputs are separated into frequency bands, and the left and right ear signals in each band are sent through respective delay lines. Left and right signal delays that give the highest signal envelope correlation are then selected to design the binaural enhancement filters of the hearing aid system.

Experimental evaluations of these prior art hearing aid systems have shown in general that the processed binaural signals do offer improved speech intelligibility when compared to a single hearing aid, but do not offer any noteworthy advantage in speech intelligibility when compared to an amplified but otherwise unprocessed binaural signal presentation. Typically, the enhancement filters of such conventional hearing aid systems pass those frequency regions that have a good SNR and attenuate those frequency regions that have a poor SNR. Such a technique changes only the compression gain of a frequency band, not the SNR of the signals within the frequency band, and thus has only a minimal effect on speech intelligibility.

Because the prior art binaural enhancement techniques do not improve speech intelligibility much beyond that already provided by binaural hearing aid systems without it, such signal processing techniques must be justified on the basis of other advantages. For example, modest amounts of spectral enhancement have been shown to improve subjective ratings of speech quality and reduce reaction time for test subjects responding to test stimuli even when the speech recognition accuracy has not really been improved. Experimental results have also suggested that a faster differentiation in listening corresponds to a greater ease of listening even if speech intelligibility is not enhanced. The same rationale can be applied to binaural enhancement algorithms where an expected user benefit would be increased listening comfort and reduced long-term listening effort.

Wiener Filter

A Wiener filter minimizes a mean-squared error between a noisy observed signal and a noise-free desired signal. In a sampled frequency domain, the Wiener filter is defined as:

$$w(k) = \frac{|S(k)|^2}{|S(k)|^2 + |N(k)|^2}, \tag{1}$$

where S(k) is a desired signal spectrum and N(k) is a noise spectrum for a frequency bin having the index k. To implement the Wiener filter, both the desired signal power spectra and the noise power spectra of the frequency bins must be known. In practice, however, these power spectra can only be estimated. Consequently, the accuracy of the power spectrum estimates determines the effectiveness of the Wiener filter.

Typically, the Wiener filter adopted in a conventional hearing aid system for binaural signal enhancement is designed using some simple approximations and/or assumptions. The first assumption is that the desired signal source is located in the front-center of the listener. As mentioned, if the desired signal source is directly in the front-center of the listener, the resulting input signals should be identical at the two ears of the listener. Moreover, it is assumed that the noise and/or interfering sources are independent, i.e., with no correlation, at the two ears. Accordingly, the inputs at the left and right ears are then given by:

$$X_L(k)=S(k)+N_L(k)$$

$$X_R(k)=S(k)+N_R(k) \tag{2}$$

where S(k) is the desired input signal and $N_L(k)$ and $N_R(k)$ are the independent left and right ear noises/interferences, respectively. A total signal plus noise power is then given by the sum of the left and right input powers:

$$|S(k)|^2+|N(k)|^2 \cong <|X_L(k)|^2>+<|X_R(k)|^2>, \tag{3}$$

where the angle brackets denote a signal average. Because the desired input signal is assumed to be identical at the two ears, the noise power can be estimated from the difference between the inputs:

$$|N(k)|^2 \cong <|X_L(k)-X_R(k)|^2>. \tag{4}$$

The estimated input signal power is then given by a difference between Eq. (3) and Eq. (4), which results in:

$$|S(k)|^2 \cong \langle |X_L(k)|^2\rangle + \langle |X_R(k)|^2\rangle - \langle |X_L(k) - X_R(k)|^2\rangle, = 2\mathrm{Re}[\langle X_L(k)X_R^*(k)\rangle], \tag{5}$$

where the asterisk denotes a complex conjugate. Accordingly, the Wiener filter of Eq. (1) can then be revised to become:

$$w(k) = \frac{2\,\mathrm{Re}[\langle X_L(k)X_R^*(k)\rangle]}{\langle |X_L(k)|^2\rangle + \langle |X_R(k)|^2\rangle}. \tag{6}$$

For a conventional binaural hearing aid system with Wiener filters at the left and right hearing aids thereof, identical filters w(k) are applied to the left and right ear inputs to produce the processed pair of outputs.

The Wiener filter defined in Eq. (6) is identical with a two-microphone binaural beamformer described by the above-mentioned Lindemann's article in 1995 and covered by the U.S. Pat. No. 5,511,128 assigned to GN ReSound, the contents of which are hereby incorporated by reference.

There are several problems with the prior art binaural hearing aid systems. One problem is the assumption that the noise at the two ears of the listener is uncorrelated, i.e., independent. This assumption causes inaccuracies in binaural signal processing, particular at the low frequency range. At low frequencies, a distance between the left and right ears of the listener is relatively small, as compared to the wavelength of a sound wave. The noise at the listener's two ears will therefore be highly correlated. Consequently, the Wiener filter and other similar prior art approaches will have only a minimal effect in improving binaural signal processing at low frequencies.

A second problem is the assumption that the desired signal source is in front-center of the listener. The desired signal source is often located to the side of the listener, an example being a conversation with a passenger while driving a car. Accordingly, a hearing aid system with the Wiener filters based on the assumption of a front-center signal source would attenuate the signal sources from the side.

A third problem is related to process artifacts, which produce audible signal distortion as the compression gain of the binaural enhancement filter changes in response to the estimated signal and noise power levels. Specifically, a power-estimation time constant that gives optimum performance at good signal-to-noise ratios (SNRs) will probably not provide enough smoothing at poor SNRs for the hearing aid system. As a result, audible fluctuations in a perceived noise level can result.

SUMMARY OF THE INVENTION

A signal processing system, such as a hearing aid system, adapted to enhance binaural input signals is provided. The signal processing system is essentially a system with a first signal channel having a first filter and a second signal channel having a second filter for processing first and second channel inputs and producing first and second channel outputs, respectively. Filter coefficients of at least one of the first and second filters are adjusted to minimize the difference between the first channel input and the second channel input in producing the first and second channel outputs. The resultant signal match processing gives broader regions of signal suppression than using the Wiener filters alone for frequency regions where the interaural correlation is low, and may be more effective in reducing the effects of interference on the desired speech signal. Modifications to the algorithms can be made to accommodate sound sources located to the sides as well as the front of the listener. Processing artifacts can be reduced by using longer averaging time constants for estimating the signal power and cross-spectra as the signal-to-noise ratio decreases. A stability constant can also be incorporated in the transfer functions of the filters to increase the stability of the signal processing system.

Thus, in one aspect, the invention is a multi-channel signal processing system, such as used in a hearing aid system, that is capable of processing signals binaurally. The signal processing system comprises a first signal channel with a first filter and a second signal channel with a second filter. The first filter processes a first channel input to produce a first channel output, and the second filter processes a second channel input to produce a second channel output. Transfer functions of the first and second filters operate to minimize a difference between the first channel input and the second channel input when producing the first channel output and the second channel output, respectively. In a preferred embodiment, the transfer functions of the first and second filters are identical. In another embodiment, the transfer functions are different. In the preferred embodiment, the difference minimized is a normalized difference between the first and second channel inputs and at least one of the filters adjusts its filter coefficients to minimize the difference in producing the first or second channel output. According to the preferred embodiment, the normalized difference is defined as $$P(k) = \frac{\langle |X_1(k) - X_2(k)|^2\rangle}{\langle |X_1(k)|^2\rangle + \langle |X_2(k)|^2\rangle},$$

where $X_1(k)$ and $X_2(k)$ are the first and second channel inputs for the frequency bin having an index k, respectively, and angle brackets denote averages of equation results inside the angle brackets. In another preferred embodiment, the normalized difference is defined as $$P(k) = \frac{|N(k)|^2}{|S(k)|^2 + |N(k)|^2},$$

where S(k) and N(k) are a signal spectrum and a noise spectrum for the frequency bin having the index k, respectively. In yet another preferred embodiment, the signal processing system further comprises a first cost function filter, a second cost function filter, and an adder. The first cost function filter is coupled to an output of the first filter and the second cost function filter is coupled to an output of the second filter. Outputs of the first and second cost function filters are received by the adder, which then compares the outputs to produce an error output. The error output is provided to one of the filters, which adjusts its filter coefficients in accordance with the error output in producing the first or the second channel output. According to this preferred embodiment, the error output is a mean square error of outputs from the first and second cost function filters. The transfer functions of the filters then operate to minimize the mean square error in producing the first and second channel outputs. In yet another preferred embodiment, a stability constant is incorporated in the transfer functions of the first and second filters to improve stability of the signal processing system. In yet another preferred embodiment, filter coefficients of the first and second filters are normalized by a maximum coefficient value, thereby reducing an overall filter gain when no frontal signal is present.

In another aspect, the present invention is a multi-channel signal processing system, such as used in a hearing aid system, that is capable of processing signals coming from any angles to the signal processing system. The signal processing system comprises a first filter receiving a first channel input and producing a first channel output and a second filter receiving a second channel input and producing a second channel output. According to a preferred embodiment, the signal processing system is adjusted to accommodate sound sources located to the sides as well as the front of a listener. The first and second filters can be Wiener filters or they can be filters adopted to process an optimal signal match described in the above-mentioned paragraphs. In yet another preferred embodiment, a directional factor is considered in determining the transfer functions of the first and second filters. According to this preferred embodiment, the directional factor is an estimated interaural phase difference of the first and second channel inputs. The first and second channel inputs $X_1(k)$ and $X_2(k)$ satisfy a condition defined as $X_2(k)=a(k)e^{j\theta(k)}X_1(k)$, where $$\cos\theta(k) = \frac{\mathrm{Re}[\langle X_1(k)X_2^*(k)\rangle]}{|\langle X_1(k)X_2^*(k)\rangle|}$$

is the phase difference between the signals. The directional factor is used as a test statistic for detecting a front signal source and the dominance thereof. If a statistic value of the directional factor is close to one, there is a dominant front signal source to the signal processing system. If otherwise, no dominant front signal sources exists and a coherence-based signal processing is applied by the signal processing system.

In yet another aspect of the present invention, the multi-channel signal processing system comprises filters having adaptive time constants to reduce artifacts at poor SNRs. The signal processing system comprises a first filter receiving a first channel input and producing a first channel output and a second filter receiving a second channel input and producing a second channel output. According to a preferred embodiment, time constants respectively of the first and second filters are adjusted in accordance with an estimated noise to signal-plus-noise ratio, thereby reducing artifacts at poor signal-to-noise-ratios (SNRs) particularly for low-pass filters.

In yet another aspect, the invention is a method for multi-channel signal processing such as used in a binaural hearing aid system, the method comprising the steps of receiving a first channel input by a first filter located in a first signal channel, receiving a second channel input by a second filter located in a second signal channel, and generating a first channel output and a second channel output by the first and second filters, respectively, by minimizing a difference between the first channel input and the second channel input. In another preferred embodiment, the step of generating first and second channel outputs comprises receiving by a first cost function filter an output from the first filter, receiving by a second cost function filter an output from the second filter, generating by an adder an error output by comparing outputs from the first and second cost function filters, and adjusting filter coefficients of at least one of the first and second filters in accordance with the error output to minimize the difference between the first channel input and the second channel input. According to this preferred embodiment, the error output is a mean square error of outputs from the first and second cost function filters. Transfer functions of the filters then operate to minimize the mean square error in producing the first and second channel outputs. In these preferred embodiments, the transfer functions of the first and second filters are identical. In another embodiment, the transfer functions are different. In the preferred embodiments, the difference minimized is a normalized difference between the first and second channel inputs and at least one of the filters adjusts its filter coefficients to minimize the difference in producing the first or second channel output. According to the preferred embodiments, the normalized difference is defined as $$P(k) = \frac{\langle |X_1(k) - X_2(k)|^2\rangle}{\langle |X_1(k)|^2\rangle + \langle |X_2(k)|^2\rangle},$$

where $X_1(k)$ and $X_2(k)$ are the first and second channel inputs for the frequency bin having the index k, respectively, and angle brackets denote averages of equation results inside the angle brackets, respectively. In another preferred embodiment, the normalized difference is defined as $$P(k) = \frac{|N(k)|^2}{|S(k)|^2 + |N(k)|^2},$$

where S(k) and N(k) are a signal spectrum and a noise spectrum for the frequency bin having the index k, respectively. In yet another preferred embodiment, a stability factor is incorporated in the transfer functions of the first and second filters to improve stability of the signal processing system. In yet another preferred embodiment, filter coefficients of the first and second filters are normalized by a maximum coefficient value, thereby reducing an overall filter gain when no frontal signal is present.

In yet another aspect, the invention is a method for multi-channel signal processing such as used in a binaural hearing aid system, the method comprising the steps calculating an estimated interaural phase difference of a first channel input and a second channel input to determine the dominance of a front signal source. According to a preferred embodiment, transfer functions of filters in a multi-channel signal processing system are adjusted to accommodate sound sources located to the sides as well as the front of a listener. The filters can be Wiener filters or they can be filters adopted to process an optimal signal match described in the above-mentioned paragraphs. The estimated interaural phase difference is a directional factor used as a test statistic for detecting a front signal source and the dominance thereof. The first and a second channel inputs $X_1(k)$ and $X_2(k)$ satisfy a condition defined as $X_2(k)=a(k)e^{j\theta(k)}X_1(k)$, where $$\cos\theta(k) = \frac{\mathrm{Re}[\langle X_1(k)X_2^*(k)\rangle]}{|\langle X_1(k)X_2^*(k)\rangle|}$$

is the phase difference between the signals. The transfer functions of the filters are determined based on a value of the direction factor. If a statistic value of the directional factor is close to one, there is a dominant front signal source to the signal processing system. If otherwise, no dominant front signal sources exists and a coherence-based signal processing is applied by the signal processing system.

In yet another aspect, the invention is a method for multi-channel signal processing such as used in a binaural hearing aid system, the method comprising the steps of generating a first channel output and a second channel output by adaptively adjusting a first time constant of a first filter and a second time constant of a second filter. According to a preferred embodiment, time constants respectively of the first and second filters are adjusted in accordance with an estimated noise to signal-plus-noise ratio, thereby reducing artifacts at poor signal-to-noise-ratios (SNRs) particularly for low-pass filters.

A further understanding of the nature and advantages of the present invention may be realized by reference to the remaining portions of the specification and the drawings.

DESCRIPTION OF THE PREFERRED EMBODIMENTS

Optimal Signal Match

Figure 1:
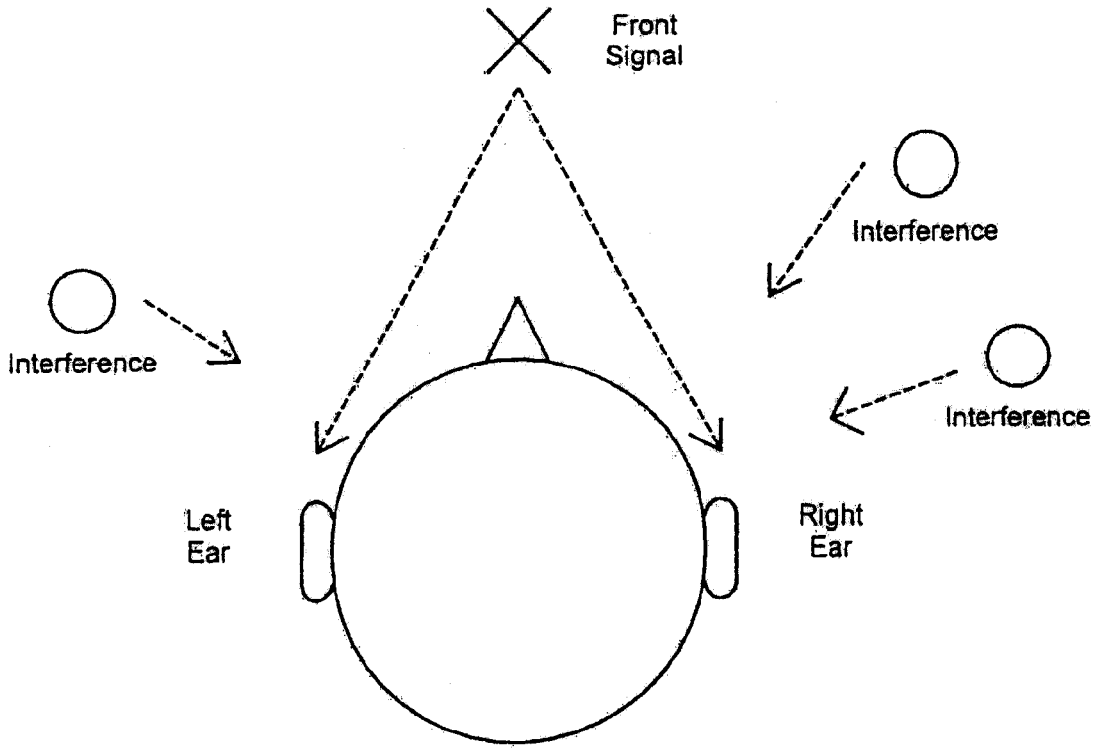
FIG. 1 illustrates a centered front signal source and sources of interference relative to a listener.
Figure 2:
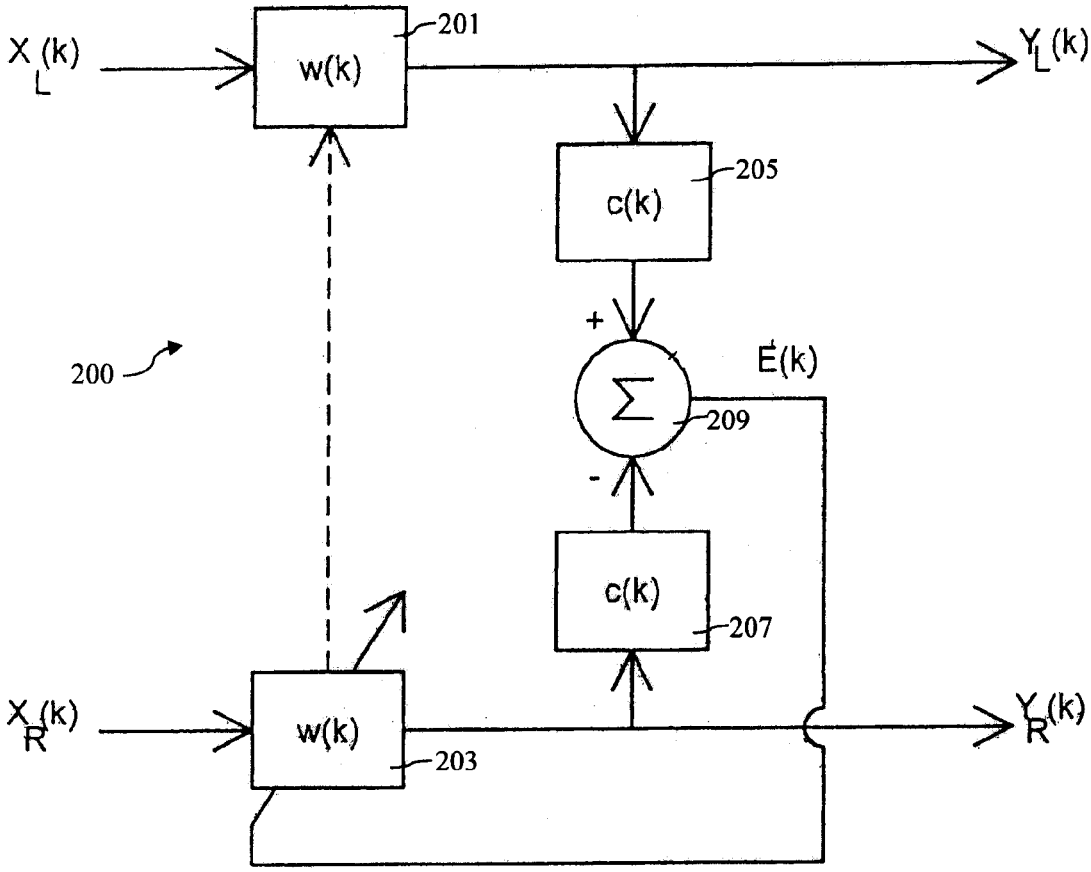
FIG. 2 illustrates a block diagram for an adaptive signal matching system according to the present invention.

To address the problems experienced by the conventional hearing aid systems, the present invention proposes an audio system, such as a binaural hearing aid system, with an alternative approach to the prior art Wiener filters. The presently described hearing aid system also incorporates a same binaural enhancement filter respectively in left and right ear hearing aids of the hearing aid system. Thus, the left and right filters of the present hearing aid system respectively has a same filter transfer function w(k) that minimizes a difference between inputs at the left and right ears of the user. More specifically, the present hearing aid system adopts an optimal signal match technique that minimizes a mean square error E(k) between the left and right signal filtered by the enhancement filters w(k) and an additional cost function given by filter c(k). FIG. 2 illustrates a simplified block diagram depicting such an inventive approach in the frequency domain implemented in the hearing aid system according to a preferred embodiment of the present invention. The two assumptions used for the conventional Wiener filter apply to this preferred embodiment as well, these being a direct front signal source with independent noise at each ear of the user. Thus, Eq. (2) still holds in defining the left and right ear inputs for the present hearing aid system.

As shown in FIG. 2, the left and right inputs $X_L(k)$ and $X_R(k)$ are respectively filtered by binaural enhancement filters 201 and 203, each with the transfer function w(k), and then by additional cost function filters 205 and 207, each with a transfer function c(k). The binaural enhancement filters 201 and 203 produce left and right output $Y_L(k)$ and $Y_R(k)$, respectively. To compare a difference between outputs of the cost function filters 205 and 207, an output for the frequency bin with index k from the cost function filter 207 is subtracted from an output for the frequency bin with index k from the cost function filter 205 by adder 209. The adder 209 sends a comparing result, an error E(k), to one of the binaural enhancement filters, e.g., the filter 203, for adjusting the binaural enhancement filter to minimize the difference between inputs at the left and right ears of the user. Accordingly, an optimal signal match for the binaural hearing aid system is accomplished by minimizing a mean squared error between the left and right inputs $X_L(k)$ and $X_R(k)$ that are respectively filtered by the enhancement filters 201 and 203 and by the additional cost function filters 205 and 207. In the preferred embodiment, the enhancement filters 201 and 203 are identical (i.e., with identical transfer functions) and the cost function filters 205 and 207 are identical for the left and right ear hearing aids of the hearing aid system, respectively. In another embodiment, the enhancement filters 201 and 203 can be different, and the cost function filters 205 and 207 can be different as well.

Minimizing the mean squared error between inputs of the two ears will minimize the filter gains of the left and right enhancement filters in those frequency bands having small cross-correlation. Such a signal processing technique will, however, tend to emphasize those frequency bands that have a high signal level even when the SNR in those bands is poor, and will tend to suppress frequency bands having a low signal level even if the SNR in those bands is high. As such, a more useful criterion for improving the speech intelligibility by the hearing aid system is provided in accordance with another preferred embodiment of the present invention.

Specifically, instead of minimizing the mean squared error between inputs of the two ears, the hearing aid system according to this second preferred embodiment has its enhancement filters designed to minimize a normalized signal difference P(k) that is defined by:

$$P(k) = \frac{\langle |X_L(k) - X_R(k)|^2 \rangle}{\langle |X_L(k)|^2 \rangle + \langle |X_R(k)|^2 \rangle}. \tag{7}$$

As shown in Eq. (7), the function P(k) is a power of the difference of the left and right inputs that are normalized by a total signal-plus-noise power. The values of function P(k) thereby range between 0 and 1. A value of 0 in Eq. (7) indicates a perfect match between the left and right inputs, and a value of 1 indicates that no input signal source is present. Given the assumptions of a front-center signal source and independent noise at the two ears, one could also derive the function P(k) as:

$$P(k) = \frac{|N(k)|^2}{|S(k)|^2 + |N(k)|^2}. \tag{8}$$

Accordingly, one of the signal processing objects of the present invention is therefore to minimize the P(k), i.e., the noise to signal-plus-noise ratio summed over the frequency bands, as shown in Eq. (8).

According to this preferred embodiment, a mean square error to be minimized is therefore given by $$\xi = \sum_{k=0}^{K} |w(k)|^2 |c(k)|^2 P(k). \tag{9}$$

Normally, this minimization must be constrained to prevent a trivial solution of setting all filter coefficients of the enhancement filters and the cost function filters to zero. A common constraint in the time domain is to set the first filter coefficients of the enhancement filters to be identically 1. A corresponding constraint in the frequency domain is to set $$\sum_{k=0}^{K} w(k) = K. \tag{10}$$

The signal processing optimization for the present hearing aid system is then to minimize the summation of Eq. (9), subject to the linear constraint given by Eq. (10). If a matrix D is defined as:

$$D = \mathrm{diag}[|c(k)|^2 P(k)], \tag{11}$$

the signal processing optimization then is equivalent to minimizing $w^H Dw$, subject to a constraint $w^H S = K$, where $s = [1, 1, 1, \ldots, 1]^T$. The superscript T denotes a transpose of a matrix, and the superscript H denotes the conjugate transpose.

A solution for the vector of coefficients, such as the $w^H Dw$, is described in "Introduction to Adaptive Arrays" by Monzingo and Miller (1980), John Wiley and Sons, pp 78-105. Applying the solution described in Monzingo and Miller, we have:

$$w = K \frac{D^{-1} s}{s^H D^{-1} s}. \tag{12}$$

Substituting the value of D from Eq. (11) yields a solution for individual coefficients as:

$$w(k) = K \frac{\left[|c(k)|^2 P(k)\right]^{-1}}{\sum_{j=0}^{K} \left[|c(j)|^2 P(j)\right]^{1}}. \tag{13}$$

The solution given by Eqs. (12) and (13) may become unstable if a frequency band contains the front-center signal with no noise. Therefore, in accordance with yet another preferred embodiment, such a stability problem can be avoided by adding a small positive stability constant λ to the diagonal of matrix D, thereby guaranteeing that the matrix is always invertible, as explained in "Robust adaptive beamforming" by Cox et al. (1987), IEEE Trans. Acoust. Speech and Sig. Proc., vol. ASSP-35 , pp 1365-1376 . This modification leads to a weighted vector solution given as:

$$w = K \frac{(D + \lambda I)^{-1} s}{s^H (D + \lambda I)^{-1} s}, \tag{14}$$

where I is an identity matrix. The most general solution for Eq. (14) is to let the stability constant λ depend on frequency, leading to the enhancement filter coefficients defined by:

$$w(k) = K \frac{\left[|c(k)|^2 P(k) + \lambda(k)\right]^{-1}}{\sum_{j=0}^{K} \left[|c(j)|^2 P(j) + \lambda(j)\right]^{-1}}. \tag{15}$$

The value of λ can also be used to control a frequency spectral shape of the binaural enhancement filter because increasing the value of λ would reduce an amount of spectral contrast in the filter. For instance, setting $\lambda \approx 0$ will give a maximum amount of signal enhancement in the frequency spectrum, while setting $\lambda >> 1$ will yield a flat enhancement filter. In yet another preferred embodiment, a value of $\lambda = 0.1$ has proven effective in providing effective binaural signal enhancement with a minimum of processing artifacts.

A potential difficulty with the optimal signal match solution is that the filter coefficients may exceed one. A second problem is that the filter coefficients will all be the same when only diffuse noise and no front-center signal is present, resulting in relatively high gains in all frequency bands and no noise suppression from the filter. Accordingly, in yet another preferred embodiment, both of these problems can be corrected using ad-hoc fixes, as explained below. Define B(k) as $$B(k) = 1 - P(k). \tag{16}$$

Substituting the P(k) in Eq. (16) with the P(k) in Eq. (7), the resulting B(k) is just a ratio of the front signal power to the total signal-plus-noise power, as given by the Wiener filter solution of Eq. (6). Therefore, the modified filter coefficients according to this preferred embodiment are given by $$\hat{w}(k) = \frac{w(k)}{\underset{j}{\mathrm{Max}}[w(j)]}\underset{m}{\mathrm{Max}}[B(m)]. \tag{17}$$

As can be seen from Eq. (17), normalization of the filter coefficients w(k) by a maximum coefficient value, i.e., $$\underset{j}{\mathrm{Max}}[w(j)],$$

resets the maximum coefficient to be one, and the scaling by the maximum value of B(m) reduces the overall filter gain when no front-center signal is present. In yet another preferred embodiment, the value of $$\underset{m}{\mathrm{Max}}[B(m)]$$

can be raised to a power greater than one to increase the noise suppression by the binaural enhancement filter when the desired signal is absent.

Off-Axis Signal Sources

Both the conventional Wiener filter and the optimum signal match algorithms of the present invention are based on the assumption that the desired source of sound is directly in front-center of the listener. This assumption, however, will not be valid in many situations such as talking in an automobile, walking with a companion, or following a conversation among several talkers. As mentioned above, a binaural enhancement filter built according to such an assumption would attenuate the signal sources from the side. Thus, there is a need for a more general solution to the binaural signal enhancement that can take into account an apparent direction of a dominant source of sound. A more effective solution in improving speech intelligibility should therefore use the frontal source assumption during signal processing only when there is a high probability that such assumption is valid, and should use a more general directional assumption otherwise.

Accordingly, in yet another preferred embodiment, for a directional signal source not in front-center of the listener, the left and right ear inputs can be related as:

$$X_L(k)=a(k)e^{j\theta(k)}X_R(k), \tag{18}$$

where $\alpha(k)$ and $\theta(k)$ are given by a head-related transfer function (HRTF) for the listener. The signal phase of the HRTF can be extracted by using $$\cos\theta(k) = \frac{\mathrm{Re}[\langle X_L(k)X_R^*(k)\rangle]}{|\langle X_L(k)X_R^*(k)\rangle|}. \tag{19}$$

For a signal source in front-center of the listener, the $\cos\theta(k)$ is equivalent to one at all frequencies. Thus, an estimated interaural phase difference of the inputs at the two ears can be used as a test statistic for detecting a frontal signal source. The proposed detection statistic, i.e., the estimated interaural phase difference of the inputs, according to this preferred embodiment is then given by:

$$\delta = \frac{1}{K+1}\sum_{k=0}^{K}\cos\theta(k). \tag{20}$$

The value of $\delta$ will be close to one if all frequency bands are dominated by a frontal signal source, and the value $\delta$ will decrease gradually as the signal source moves towards the side of the listener.

As such, if $|\delta|\approx 1$, the binaural signal enhancement processing should use forms based on the assumption of a front-center source of sound. The signal enhancement filter built under such assumption can therefore be the Wiener filter given by Eq. (6) or the presently described optimal signal match filter given by Eq. (15), etc. When $|\delta|<<1$, on the other hand, the signal enhancement processing of the binaural enhancement filter should be based on the assumption that a desired source of sound is not in front-center of the listener. A frequency domain solution using a coherence function analysis satisfies this non-front-center requirement. An example of the coherence function is described in "Estimation of the magnitude-squared coherence function via the overlapped fast Fourier transform" by Carter et al. (1973), IEEE Trans. Audio and Electroacoustics, vol. AU-21, pp 337-389 . Accordingly, in accordance with yet another preferred embodiment, a coherence between the left and right ear inputs as defined by Eq. (18) can be given by $$\gamma(k) = \frac{\langle X_L(k)X_R^*(k)\rangle}{[\langle|X_L(k)|^2\rangle\langle|X_R(k)|^2\rangle]^{1/2}} = e^{j\theta(k)}. \tag{21}$$

As can be seen from Eq. (21), the magnitude of the coherence between the left and right ear inputs is one for any angle of the signal source.

The binaural signal enhancement processing for the limiting cases of $\delta$ is summarized in Table 1 below. The signal processing by the Wiener filter uses the approach suggested in the present invention and given by Eq. (6) for $|\delta|\approx 1$, but is replaced by the coherence-based processing according to the present invention for $|\delta|\approx 0$, as shown in Table 1 . Furthermore, Table 1 also shows the optimal signal match processing based on the preferred embodiments according to the present invention for $|\delta|\approx 1$, and the optional signal match processing based on a preferred embodiment using the coherence for $|\delta|\approx 0$ .

TABLE 1

| Processing | $\lvert\delta\rvert \approx 1$ | $\lvert\delta\rvert \approx 0$ |
|---|---|---|
| Wiener Filter | $w_1(k) = \frac{2\mathrm{Re}[\langle X_L(k)X_R^*(k)\rangle]}{\langle \lvert X_L(k)\rvert^2\rangle + \langle \lvert X_R(k)\rvert^2\rangle}$ | $w_0(k) = \frac{\langle X_L(k)X_R^*(k)\rangle}{[\langle \lvert X_L(k)\rvert^2\rangle\langle \lvert X_R(k)\rvert^2\rangle]^{1/2}}$ |
| Optimal Signal Match | $P_1(k) = 1 - \frac{2\mathrm{Re}[\langle X_L(k)X_R^*(k)\rangle]}{\langle \lvert X_L(k)\rvert^2\rangle + \langle \lvert X_R(k)\rvert^2\rangle}$ <br> $w_1(k) \propto [c(k)P_1(k) + \lambda(k)]^{-1}$ | $P_0(k) = 1 - \frac{\langle X_L(k)X_R^*(k)\rangle}{[\langle \lvert X_L(k)\rvert^2\rangle\langle \lvert X_R(k)\rvert^2\rangle]^{1/2}}$ <br> $w_0(k) \propto [c(k)P_0(k) + \lambda(k)]^{-1}$ |

For incoming signals having an angle of arrival intermediate between the two limiting cases, i.e., $|\delta|\approx 0$ and $|\delta|\approx 1$ , a blend of the frontal and coherence processing approaches can be used. A gradual transition between the $|\delta|\approx 1$ and the $|\delta|\approx 0$ cases for intermediate values of $\delta$ will minimize audible processing artifacts. Accordingly, in yet another preferred embodiment of the present invention, the signal processing for the Wiener filter approach can be revised as:

$$w(k)=dw_1(k)+(1-d)w_0(k), \tag{22}$$

where $w_1(k)$ and $w_0(k)$ are defined in Table 1 . For the optimal signal match approach, the signal processing becomes $$P(k)=dP_1(k)+(1-d)P_0(k)w(k)\propto[c(k)P(k)+\lambda(k)]^{-1} \tag{23}$$

where $P_1(k)$ and $P_0(k)$ are defined in Table 1 . According to the preferred embodiments, for both the Wiener filter processing and the optimal signal match processing to be effective, the values of d are to set as:

$$d = \begin{cases} 1, & \delta \geq 0.75 \\ 2\times(\delta - 0.25), & 0.25 < \delta < 0.75 \\ 0, & \delta \leq 0.25 \end{cases}. \tag{24}$$

Figure 3:
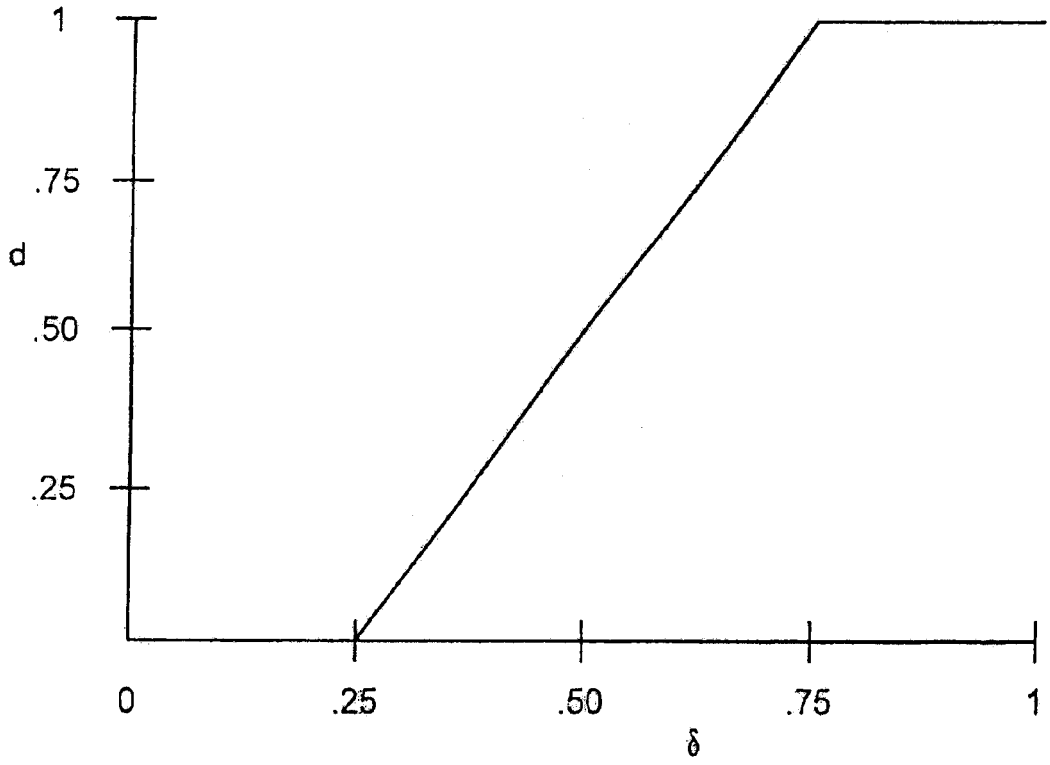
FIG. 3 illustrates the variation of a directional factor d with an estimated cosine of an angle of arrival δ.

The directional factor d as a function of $\delta$ is plotted in FIG. 3.

Adaptive Time Constant

The variance of the filter coefficients depends on the SNR of the front signal and the diffuse noise. At poor SNR values the variance of the filter coefficients increases, and this increase in coefficient variance contributes to audible processing artifacts such as the "pumping" of the background noise level with changes in the filter gain. The artifacts can be reduced in intensity by using a longer time constant at poor SNRs when estimating the signal power and cross-spectra.

One approach to reducing artifacts is to make the low-pass filter time constant a function of the estimated noise to signal-plus-noise ratio given by P(k) in Eq (8). Define $$\rho = \frac{1}{K+1}\sum_{k=0}^{k} P(k), \tag{25}$$

which gives the estimated noise to signal-plus-noise ratio averaged across frequency. The time constant for the low-pass filters is then a function of $\rho$ estimated for each processing segment. A function that appears to be effective in preliminary informal listening tests is to set $$\tau = \begin{cases} 50 \text{ msec}, & \rho \leq 0.3 \\ 50 + 667\times(\rho - 0.3) \text{ msec}, & 0.3 < \rho < 0.6 \\ 250 \text{ msec}, & \rho \geq 0.6 \end{cases}. \tag{26}$$

Figure 4:
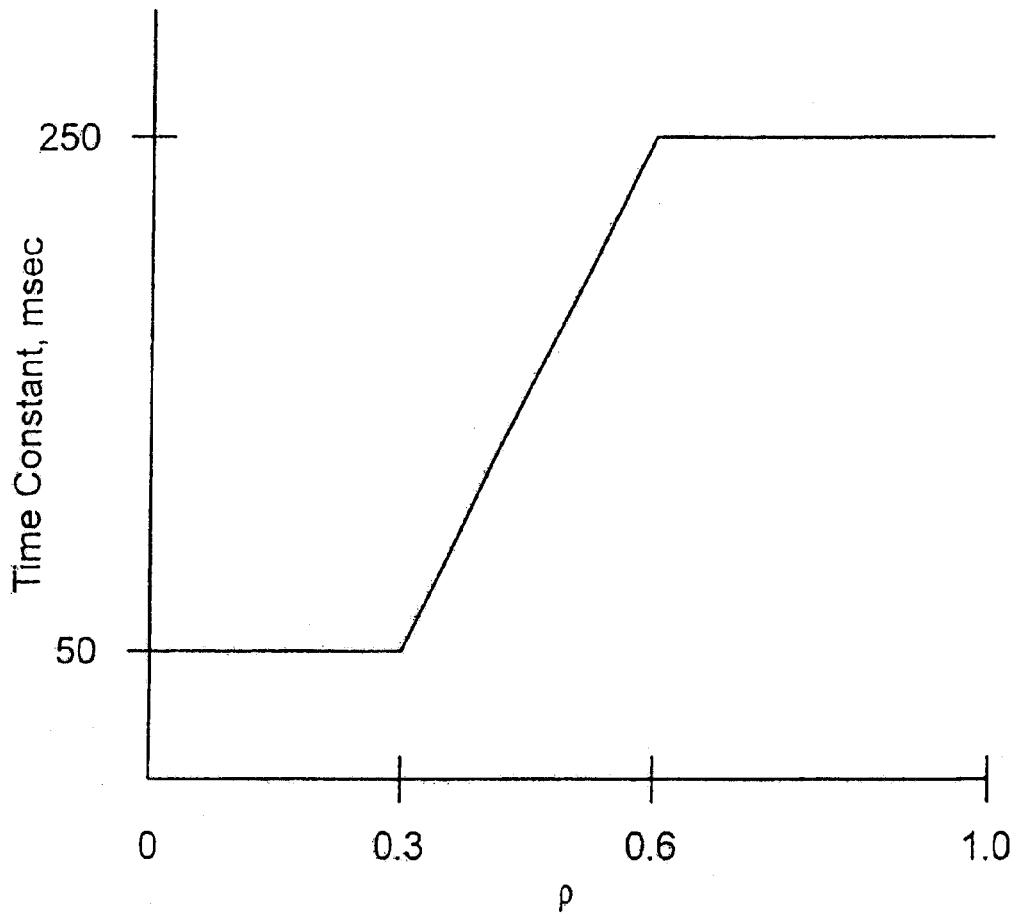
FIG. 4 illustrates the variation of the time constant with an estimated N/(S+N) ratio given by ρ.

Thus, a time constant of 50 msec is used at good SNRs to give a syllabic response to the incoming speech. As the SNR decreases, the time constant increases to a maximum of 250 msec to reduce the artifacts in the processed signal. This approach to adjusting the spectral estimation time constant can be used both for the Wiener filter and for the optimal signal match processing. A plot of the variation of the time constant with $\rho$ is presented in FIG. 4.

Adaptive Stability Constant

The value of $\lambda$ selected in Eqs (14) and (15) will affect the peak-to-valley ratio of the frequency-domain enhancement filter. At poor SNRs, setting $\lambda$ greater than zero will reduce the processing effectiveness by reducing the depth of the valleys in the gain vs. frequency function. Furthermore, $\lambda$ is not needed at poor SNRs because the high level of background noise guarantees that the inverse of the matrix D will be stable because there will be no zero or near-zero matrix elements.

The processing effectiveness can be increased by decreasing the value of $\lambda$ as the noise level increases. The $\lambda$, thus, becomes a function of the estimated noise to signal-plus-noise for each block of data. One approach is to set $$\lambda = \lambda_0 - \underset{k}{\mathrm{Min}}[c(k)P(k)], \tag{27}$$

where $\lambda_0$ is a default value, such as $\lambda_0=0.1$ , that defines the processing effects at good SNRs. An additional constraint that $\lambda>0$ is needed to prevent too much enhancement gain variation as the noise level increases. Since the adaptive value of $\lambda$ increases the processing effects at high noise levels, it can lead to increased processing artifacts if a fast time constant is used for the spectral estimation. The adaptive $\lambda$ should therefore be combined with the adaptive spectral estimation time constant discussed in the section above to give an optimal signal match system that maximizes the processing effectiveness under all SNR conditions while minimizing processing artifacts.

Simulation Results

Procedure

Two binaural enhancement systems based on the assumption of a sound source directly in front of the listener were simulated in MATLAB using floating-point arithmetic.

Simulation results illustrate the ability of the different systems to suppress an off-axis sound source when the processing is implemented with the assumption that the desired source of sound is in front of the listener. A test signal was speech-shaped noise generated by passing white noise through a band-pass filter comprising a 3-pole high-pass filter with a cutoff at 200 Hz and a 3-pole low-pass filter with a cutoff at 5000 Hz to restrict the signal bandwidth, and a 1-pole low-pass filter with a cutoff at 900 Hz to give a speech-shaped spectrum. The azimuth of the test signal was varied from 0 to 90 deg, and the hearing-aid microphone input signals were simulated using a spherical head model developed for binaural sound synthesis. The head model provided realistic signal leakage from one side of the head to the other, and the left and right ear signals were similar to those that would be obtained in the free-field testing of a binaural behind-the-ear (BTE) system in an anechoic environment.

The signal processing was implemented using a compressor structure based on digital frequency warping. The sampling rate was 16 kHz. The incoming signals for each ear were processed in blocks of 32 samples having an overlap of 16 samples. A cascade of one-pole/one-zero all-pass filters were used to give the frequency warping, with a filter warping parameter of 0.56. The all-pass filter outputs were weighted with a hanning (von Hann) window prior to computing a 32-point FFT used to give the warped frequency analysis bands.

The simulation system provides 17 frequency bands from 0 to 8 kHz on a Bark frequency scale, with each band being approximately 1.3 Bark wide. The band center frequencies are given below in Table 2 . The short-term spectra of the signals at the left and right ears were computed once every millisecond, and the power spectrum and cross-spectrum estimates were updated every millisecond using a 1-pole low-pass filter having a 250-msec time constant. The time constant was chosen to give a low-variance estimate of the steady-state enhancement gains after processing 1 sec of data, and is not necessarily the time constant that would be chosen to process speech in a hearing aid. The binaural enhancement systems, as shown in FIG. 2, use a pair of identical filter w to process the left and right input signals to give the enhanced outputs.

Wiener Filter Simulation Results

Figure 5:
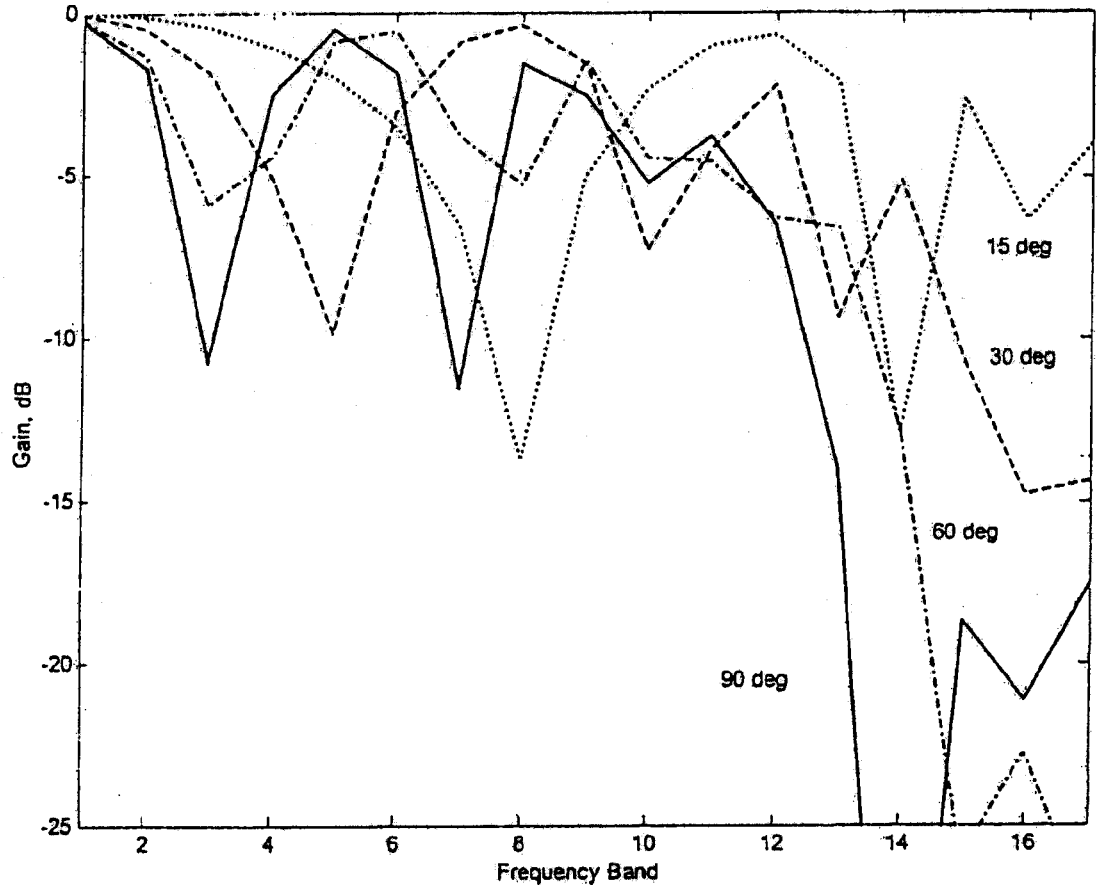
FIG. 5 illustrates simulation results for the conventional Wiener filter according to Eq. 6.

The results for the prior art Wiener filter of Eq (6) are shown in FIG. 5. For an input at zero deg azimuth there is no attenuation, and therefore this curve is not plotted. For the source at 15 deg, there are two nulls at band 8 (1340 Hz) and band 14 (4761 Hz), and otherwise little attenuation. For the source at 30 deg, there are nulls at band 5 (728 Hz), band 10 (1952 Hz), band 13 (3698 Hz), and then a gradual increases in attenuation to a maximum of 15 dB. For the source at 60 deg, there are nulls at band 3 (415 Hz), band 8 (1340 Hz), band 10 (1952 Hz), and then a smooth increase in attenuation to a maximum of over 25 dB at the highest frequencies. The source at 90 deg results in nulls at bands 3, 7, and 10 (415, 1108, and 1952 Hz, respectively) with increased attenuation at higher frequencies.

At low frequencies, the signal difference between the left and right ears is primarily a time delay. If the signals are in phase at the two ears, a correlation peak will result and there will be no attenuation. If the signals are 90 deg out of phase, however, the cross-correlation will be nearly zero and maximum attenuation will occur. This correlation behavior produces a periodic series of peaks and valleys in the enhancement gain as the interaural phase changes with frequency. The signal azimuth of 15 deg produces the shortest interaural delay, and the first correlation null occurs in band 8 (1340 Hz). As the azimuth moves towards 90 deg, the interaural time delay increases and the null moves lower in frequency, occurring in band 3 (415 Hz) for the 60 and 90 deg azimuths.

At higher frequencies, interaural amplitude differences will also occur. Interaural amplitude differences will reduce the computed enhancement gain, and the amplitude differences increase as the azimuth increases from 0 towards 90 deg. The increasing analysis filter bandwidths at high frequencies also mean that an increasing number of periods of phase and amplitude perturbations will be included within each frequency band. The result of these high-frequency effects is a substantial increase in the processing attenuation and smoother attenuation curves with increasing azimuth. The boundary between the low-frequency and high-frequency regions is at approximately 1500 Hz (band 9), since the head is about a wavelength wide at this frequency.

Optimal Signal Match

Figure 6:
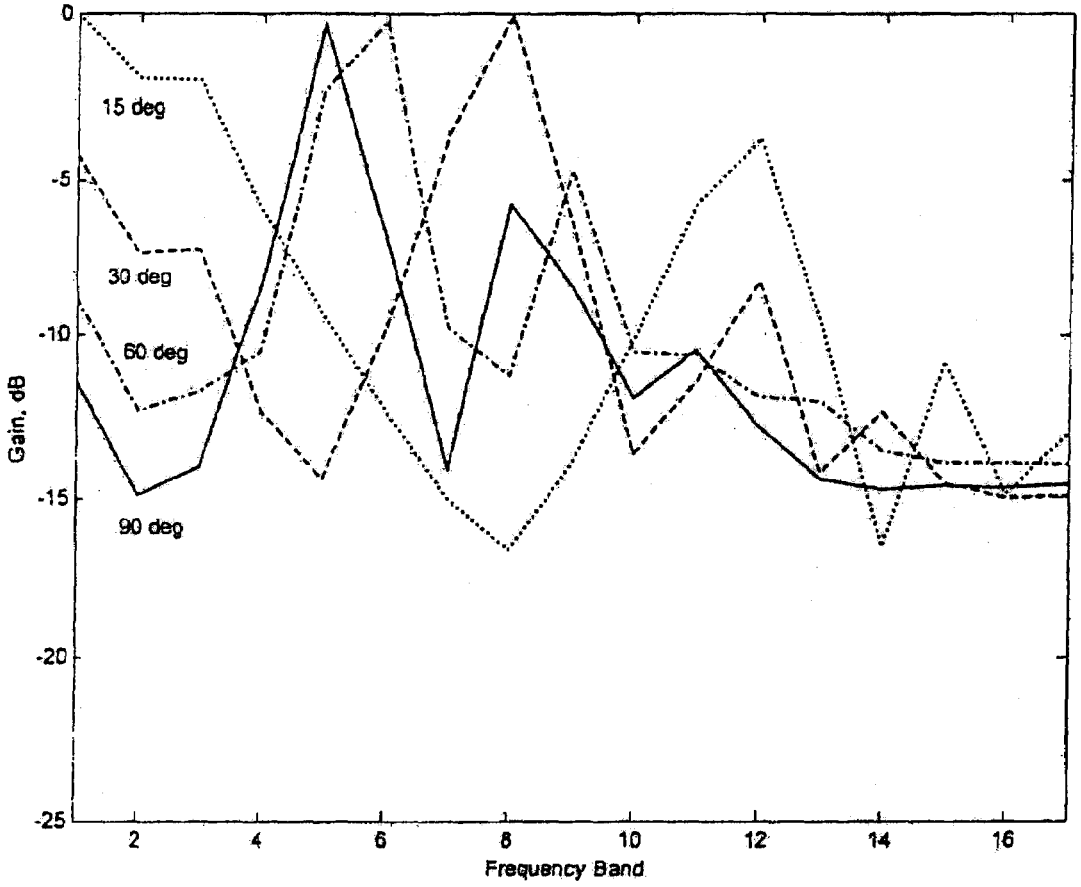
FIG. 6 illustrates simulation results for the adaptive signal matching system according to the present invention.

Simulation results for the new optimum signal match processing according to the present invention are shown in FIG. 6. The processing filter is given by Eq. (17) with a value of $\lambda=0.1$ used at all frequencies to ensure system stability. The scaling function B(m) is the same as the Wiener filter given by Eq. (6).

As was the case for the Wiener filter, the signal match processing also provides no attenuation for a source at 0 deg. For a source at 15 deg, the signal match processing gives nulls at bands 8 and 14, which are the same frequency bands where the Wiener filter gave nulls. The gain peaks for the source at 15 deg for the signal match processing are at bands 0 (0 Hz) and 12 (2937 Hz), which also matches the Wiener filter results. The major difference between the Wiener filter and the presently described signal match processing is in the shape of the gain curve with frequency. The Wiener filter gains, which are proportional to the interaural signal similarity, have sharp nulls and broad peaks. The signal match processing gains, which are instead inversely proportional to the lack of interaural signal of similarity, have broad nulls and sharp peaks. This difference in the shapes of the nulls and peaks is an inherent distinction between the two processing approaches, and is similar to the difference between a conventional FFT and high-resolution frequency analysis techniques such as the maximum likelihood technique.

For the source at 30 deg, the signal match processing has nulls at bands 5, 10, and 13, which agrees exactly with the null locations for the Wiener filter. Similarly, the source at 60 deg has nulls at bands 2, 8, and 10, which disagrees with the Wiener filter results only in the location of the lowest-frequency null, and the source at 90 deg has nulls at bands 2, 7, and 10. Thus, both the Wiener filter and the signal match processing are governed by the same underlying acoustics. However, the difference in signal processing results in the signal match system having broader regions of signal attenuation and substantially more reduction of the interfering signal power than offered by the Wiener filter.

The depth of the notches in the signal match processing is controlled by the parameter $\lambda$. Setting $\lambda=0.1$, as was done for the results of FIG. 6, gives a maximum of about 20 dB of attenuation. Decreasing the value of $\lambda$ will increase the amount of attenuation, and thus give deeper valleys and sharper peaks in the processing gain-versus-frequency curves. More attenuation is not necessarily desirable, however, because deeper valleys will also cause more audible processing artifacts to occur. There is thus an important trade-off between the averaging time constant used to estimate the power- and cross-spectra and the value of λ used to control the notch depth.

TABLE 2

| Frequency Band | Center Frequency, Hz |
|---|---|
| 0 | 0 |
| 1 | 135 |
| 2 | 273 |
| 3 | 415 |
| 4 | 566 |
| 5 | 728 |
| 6 | 907 |
| 7 | 1108 |
| 8 | 1340 |
| 9 | 1615 |
| 10 | 1952 |
| 11 | 2378 |
| 12 | 2937 |
| 13 | 3698 |
| 14 | 4761 |
| 15 | 6215 |
| 16 | 8000 |

What is claimed is:

1. A multi-channel signal processing system, comprising:

a first signal channel, said first signal channel comprising a first filter with a first filter transfer function for processing a first channel input to produce a first channel output; and a second signal channel, said second signal channel comprising a second filter with a second filter transfer function for processing a second channel input to produce a second channel output, wherein the first and second filters operate to minimize a difference between the first channel output and the second channel output, wherein said first and second channel inputs are processed binaurally to produce the first channel output and the second channel output.

2. The multi-channel signal processing system of claim 1, wherein the difference is a mean square error between the first channel output and the second channel output.

3. The multi-channel signal processing system of claim 1, wherein the difference is a normalized difference P between the first channel output and the second channel output.

4. The multi-channel signal processing system of claim 3, wherein the first and second filter transfer functions are identical and are normalized by a maximum coefficient value.

5. The multi-channel signal processing system of claim 4, wherein the first and second filter transfer functions are given as:

$$\hat{w}(k) = \frac{w(k)}{\underset{j}{\mathrm{Max}}[w(j)]}\underset{m}{\mathrm{Max}}[B(m)],$$

where B(k) is defined as B(k)=1−P(k), and w(k) is a non-normalized filter transfer function of said first and second filters and is defined as $$w(k) = \frac{2\,\mathrm{Re}[\langle X_1(k)X_2^*(k)\rangle]}{\langle |X_1(k)|^2\rangle + \langle |X_2(k)|^2\rangle},$$

and ŵ(k) is the normalized filter transfer function of said first and second filters for the frequency bin having the index k, and where $X_1(k)$ is the first channel input for the frequency bin having the index k and $X_2(k)$ is the second channel input for the frequency bin having the index k.

6. The multi-channel signal processing system of claim 3, further comprising:

a first cost function filter coupled to said first filter for receiving the first channel output;

a second cost function filter coupled to said second filter for receiving the second channel output; and an adder coupled to said first and second cost function filters, said adder receiving outputs from said first and second cost function filters and generating an error output to said second filter, wherein said second filter adjusts its filter coefficients in accordance with the error output to minimize the normalized difference P between the first and second channel outputs.

7. The multi-channel signal processing system of claim 6, wherein the first filter transfer function of said first filter and the second filter transfer function of said second filter are identical and transfer functions of said first and second cost function filters are identical.

8. The multi-channel signal processing system of claim 7, wherein the normalized difference P is defined as:

$$P(k) = \frac{|N(k)|^2}{|S(k)|^2 + |N(k)|^2},$$

where S(k) is a signal spectrum for the frequency bin having an index k and N(k) is a noise spectrum for the frequency bin having the index k.

9. The multi-channel signal processing system of claim 8, wherein the error output produced by said adder is a mean square error ξ of the first channel and second channel outputs, said second filter adjusting its filter coefficients to minimize the mean square error ξ.

10. The multi-channel signal processing system of claim 9, wherein the mean square error is defined as:

$$\xi = \sum_{k=0}^{K} |w(k)|^2 |c(k)|^2 P(k),$$

where w(k) is the transfer function of the first and second filters for the frequency bin having the index k and c(k) is the transfer function of the first and second cost function filters for the frequency bin having the index k.

11. The multi-channel signal processing system of claim 10, wherein, in the time domain, filter coefficients of the first and second filters are set to be identically 1.

12. The multi-channel signal processing system of claim 11, wherein the transfer function w(k) in the mean square error ξ satisfies a condition defined as:

$$\sum_{k=0}^{K} w(k) = K.$$

13. The multi-channel signal processing system of claim 1, wherein the first and second filters are Wiener filters.

14. The multi-channel signal processing system of claim 13, wherein the first and second filters operate to minimize a difference P(k) between the first channel output and the second channel output for a frequency bin having an index k.

15. The multi-channel signal processing system of claim 14, wherein the difference P(k) minimized is a normalized difference between the first and second channel outputs.

16. The multi-channel signal processing system of claim 15, further comprising:

a first cost function filter coupled to said first filter for receiving the first channel output;

a second cost function filter coupled to said second filter for receiving the second channel output; and an adder coupled to said first and second cost function filters, said adder receiving outputs from said first and second cost function filters and generating an error output to said second filter, wherein said second filter adjusts its filter coefficients in accordance with the error output to minimize the normalized difference P(k) between the first and second channel outputs.

17. The multi-channel signal processing system of claim 16, wherein the first and second filter transfer functions are identical and the transfer functions respectively of the first and second cost function filters are identical.

18. The multi-channel signal processing system of claim 1, wherein the first and second filters are further being adapted to process general directional sound sources that can come from any angles to the multi-channel signal processing system, and wherein as estimated interaural phase difference δ of the first and second channel inputs is computed as a statistic to determine the dominance of a frontal sound source, wherein the difference between the first channel output and the second channel output is adapted to be minimized by an adjustment of the first and second transfer functions in dependence of the estimated interaural phase difference δ.

19. The multi-channel signal processing system of claim 1, wherein the first filter has an adaptive first filter time constant for processing the first channel input; and the second filter has an adaptive second filter time constant for processing the second channel input, wherein the difference between the first channel output and the second channel output is adapted to be minimized by adapting the first and second filter time constants to reduce artifacts of the multi-channel signal processing system.

20. The multi-channel signal processing system of claim 16, wherein the first and second filters are low pass filters and the first and second filter time constants are respectively a function of an estimated noise to signal-plus-noise ratio.

21. The multi-channel signal processing system of claim 20, wherein the first and second filter transfer functions are identical.

22. The multi-channel signal processing system of claim 1, wherein the first channel input and the second channel input are associated with left and right ears, respectively.

23. A method for processing signals in an audio system, comprising the steps of:

receiving a first channel input by a first filter located in a first signal channel;

receiving a second channel input by a second filter located in a second signal channel; and generating a first channel output and a second channel output by minimizing a difference between the first channel output and the second channel output, and wherein the first and the second channel inputs are processed binaurally.

24. The method of claim 23, wherein the difference is normalized by a total signal-plus-noise power.

25. The method of claim 24, wherein the normalized difference is P(k) defined as:

$$P(k) = \frac{|N(k)|^2}{|S(k)|^2 + |N(k)|^2},$$

where S(k) is a signal spectrum for the frequency bin having the index k and N(k) is a noise spectrum for the frequency bin having the index k.

26. The method of claim 25, wherein the step of generating first and second channel outputs comprises:

receiving by a first cost function filter an output from the first filter;

receiving by a second cost function filter an output from the second filter;

generating by an adder an error output by comparing outputs from the first and second cost function filters; and adjusting filter coefficients of at least one of the first and second filters in accordance with the error output to minimize the normalized difference between the first channel output and the second channel output.

27. The method of claim 26, wherein transfer functions of the first and second filters are identical and transfer functions of the first and second cost function filters are identical.

28. The method of claim 27, wherein the step of adjusting filter coefficients of the one of the first and second filters comprises the step of minimizing a mean square error ξ of the error output.

29. The method of claim 28, wherein the mean square error ξ is defined as $$\xi = \sum_{k=0}^{K} |w(k)|^2 |c(k)|^2 P(k),$$

where w(k) is the transfer function of the first and second filters for the frequency bin having an index k and c(k) is the transfer function of the first and second cost function filters for the frequency bin having the index k.

30. The method of claim 29, wherein the transfer function w(k) in the mean square error ξ satisfies a condition defined as:

$$\sum_{k=0}^{K} w(k) = K.$$

31. The method of claim 23, wherein the minimization of the difference between the first channel output and the second channel output comprises the steps of: adaptively adjusting a first time constant of the first filter and a second time constant of the second filter, wherein the first and second time constants are respectively a function of an estimated noise to signal-plus-noise ratio.

32. The method of claim 23, wherein the minimization of the difference between the first channel output and the second channel output comprises the steps of:

calculating an estimated interaural phase difference δ of the first and second channel input as a statistic to determine the dominance of a frontal sound source; and adjusting the transfer function of the first filter and the transfer function of the second filter in accordance with the estimated interaural phase difference δ.

33. The method of claim 23, wherein the first channel input and the second channel input are associated with left and right ears, respectively.

34. A signal processing system, comprising:

a first filter means receiving a first channel input for generating a first channel output; and a second filter means receiving a second channel input for generating a second channel output, wherein a first transfer function of said first filter means and a second transfer function of said second filter means operate to minimize a difference between the first channel output and the second channel output, wherein said first and second channel input are processed binaurally to produce first channel output and the second channel output.

35. The signal processing system of claim 34, wherein the difference minimized is a difference normalized by a total signal-plus-noise power.

36. The signal processing system of claim 35, further comprising:

a first cost function filter means receiving the first channel output for generating a first cost function output;

a second cost function filter means receiving the second channel output for generating a second cost function output; and an adder means comparing a second cost function output with the first cost function output for generating an error output, wherein said second filter means adjusts its filter coefficients in accordance with the error output to minimize the difference between the first and second channel outputs.

37. The signal processing system of claim 36, wherein said second filter means adjusts its filter coefficients to minimize a mean square error ξ of the error output.

38. The signal processing system of claim 37, wherein the first transfer function of said first filter means and the second transfer function of said second filter means are identical, transfer functions of said first and second cost function filter means are identical.

39. The signal processing system of claim 38, wherein the mean square error ξ is defined as $$\xi = \sum_{k=0}^{K} |w(k)|^2 |c(k)|^2 P(k),$$

where w(k) is the transfer function of the first and second filter means and c(k) is the transfer function of the first and second cost function filter means for the frequency bin having an index k.

40. The signal processing system of claim 39, wherein filter coefficients of the first and second filter means in the time domain are set to be identically 1.

41. The signal processing system of claim 40, wherein the transfer function w(k) in the mean square error ξ satisfies a condition defined as:

$$\sum_{k=0}^{K} w(k) = K.$$

42. The signal processing system of claim 41, wherein each filter coefficient of the transfer function w(k) is a weighted vector including a stability factor λ.

43. The signal processing system of claim 34, wherein the first filter means has an adaptive first filter time constant; and the second filter means has an adaptive second filter time constant, wherein the difference between the first channel input and the second channel input is adapted to be minimized by adapting the first and second filter time constants to reduce artifacts of the signal processing system.

44. The signal processing system of claim 43, wherein the adaptive first and second filter time constants are respectively a function of an estimated noise to signal-plus-noise ratio.

45. The signal processing system of claim 34, wherein, the first and second filters are further being adapted to process general directional sound sources that can come from any angles to the signal processing system, wherein an estimated interaural phase difference δ of the first and second channel inputs is computed as a statistic to determine the dominance of a frontal sound source, wherein the difference between the first channel input and the second channel input is adapted to be minimized by an adjustment of the first and second transfer functions respectively in dependence on the estimated interaural phase difference δ.

46. The singal processing system of claim 34, wherein the first channel input and the second channel input are associated with left and right ears, respectively.

* * * * *